US009103614B2

(12) United States Patent
Froehle et al.

(10) Patent No.: US 9,103,614 B2
(45) Date of Patent: Aug. 11, 2015

(54) QUICK LOADING MAGAZINE

(76) Inventors: David Froehle, Edmond, OK (US); Michael Gund, Santa Maria, CA (US); Shara Maikranz, Berkeley, CA (US)

( * ) Notice: Subject to any disclaimer, the term of this patent is extended or adjusted under 35 U.S.C. 154(b) by 510 days.

(21) Appl. No.: 13/304,904

(22) Filed: Nov. 28, 2011

(65) Prior Publication Data

US 2012/0131830 A1 May 31, 2012

Related U.S. Application Data

(60) Provisional application No. 61/417,718, filed on Nov. 29, 2010.

(51) Int. Cl.
*F41A 9/61* (2006.01)
*F41A 9/67* (2006.01)

(52) U.S. Cl.
CPC ..... *F41A 9/67* (2013.01)

(58) Field of Classification Search
CPC ..... F41A 9/65; F41A 9/66; F41A 9/67; F41A 9/83
USPC ..... 42/49.01–49.1, 87; 89/33.01, 33.1
See application file for complete search history.

(56) References Cited

U.S. PATENT DOCUMENTS 1,044,983 A * 11/1912 Brown ..... 42/50
1,245,499 A * 11/1917 Orme ..... 42/7
1,299,303 A * 4/1919 Cowles ..... 42/50
1,351,370 A * 8/1920 Chase ..... 42/7
1,797,951 A * 3/1931 Gaidos ..... 42/50
2,137,491 A * 11/1938 Huff ..... 42/90
2,396,816 A * 3/1946 Boudreau ..... 42/50
2,620,582 A * 12/1952 Stukas ..... 42/50
2,885,811 A * 5/1959 Womble, Jr. ..... 42/50
2,910,795 A * 11/1959 Agren ..... 42/50
3,509,655 A * 5/1970 Wilhelm ..... 42/50
3,906,652 A * 9/1975 Evans ..... 42/50
4,107,863 A * 8/1978 Musgrave ..... 42/50
4,226,041 A * 10/1980 Goodworth ..... 42/50
4,258,495 A * 3/1981 Musgrave ..... 42/50
4,315,378 A * 2/1982 Musgrave ..... 42/50
4,329,802 A * 5/1982 Coonan ..... 42/50
4,430,821 A * 2/1984 Vincent ..... 42/50
4,488,371 A * 12/1984 Boyles ..... 42/90
4,509,283 A * 4/1985 Chesnut ..... 42/50
4,514,922 A * 5/1985 Farrar et al. ..... 42/50
4,516,346 A * 5/1985 Farrar et al. ..... 42/50
4,614,052 A * 9/1986 Brown et al. ..... 42/87
4,776,122 A * 10/1988 Dieringer et al. ..... 42/50
4,879,828 A * 11/1989 Dieringer et al. ..... 42/50
4,888,899 A * 12/1989 Chesnut et al. ..... 42/50
4,995,179 A * 2/1991 Switzer ..... 42/50
5,081,778 A * 1/1992 Switzer ..... 42/50
5,099,595 A * 3/1992 Chesnut et al. ..... 42/50
5,113,604 A * 5/1992 Vyprachticky ..... 42/50
5,309,660 A * 5/1994 Blackamore ..... 42/50

(Continued)

*Primary Examiner* — Michelle R Clement
(74) *Attorney, Agent, or Firm* — Dorsey & Whitney LLP

(57) ABSTRACT

The present disclosure provides a quick loading magazine that is easier and less cumbersome than previous ammunition magazines. A quick loading magazine is disclosed. An upper portion of the quick loading magazine is coupled to a lower portion, with the upper and lower portions defining a slider channel and a bullet channel. A feeder lip is coupled to the upper portion. A slider is configured to travel along the slider channel between a first position and a second position. A follower is coupled to the slider by a biasing member, and the follower is also configured to travel within the bullet channel.

17 Claims, 20 Drawing Sheets

(56) References Cited

U.S. PATENT DOCUMENTS

| | | | | |
|---|---|---|---|---|
| 5,502,913 | A * | 4/1996 | Jackson | 42/50 |
| 5,642,582 | A * | 7/1997 | Grams | 42/50 |
| 6,568,115 | B2 * | 5/2003 | Beretta | 42/50 |
| 6,807,764 | B1 * | 10/2004 | Phillips | 42/87 |
| 7,200,964 | B2 | 4/2007 | Gates | |
| 7,497,044 | B2 | 3/2009 | Cammenga et al. | |
| 8,316,567 | B2 * | 11/2012 | Douglas | 42/50 |
| 8,407,922 | B1 * | 4/2013 | Taylor | 42/49.01 |
| 2011/0030259 | A1 * | 2/2011 | Castro et al. | 42/6 |
| 2011/0107639 | A1 * | 5/2011 | Douglas | 42/50 |
| 2011/0167694 | A1 * | 7/2011 | Bigley et al. | 42/50 |
| 2012/0131830 | A1 * | 5/2012 | Froehle et al. | 42/49.01 |
| 2013/0247437 | A1 * | 9/2013 | Obermeit | 42/49.01 |

* cited by examiner

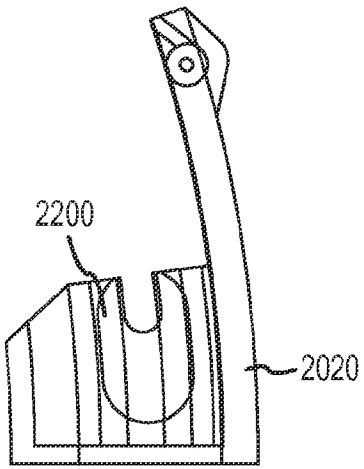
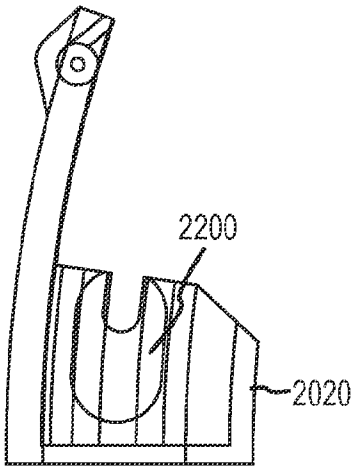
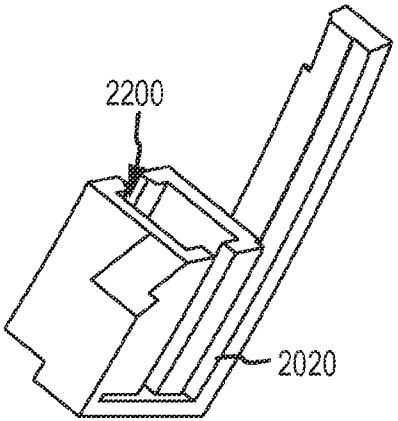
FIG.2K

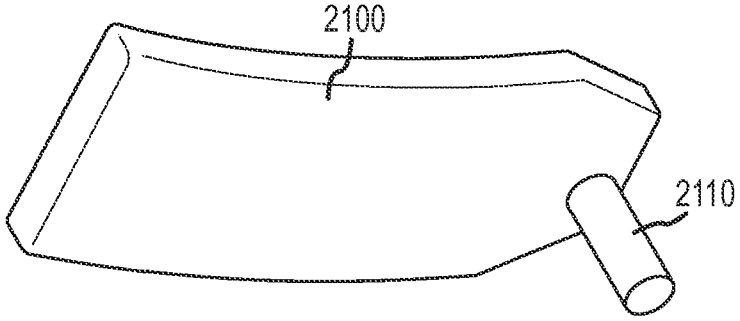
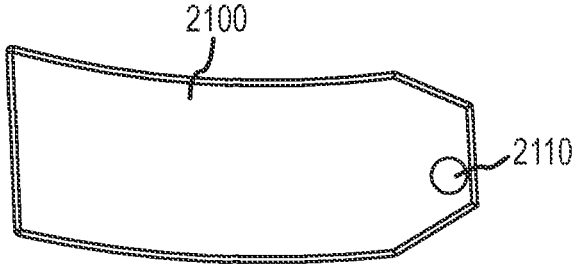
FIG.2N

QUICK LOADING MAGAZINE

CROSS-REFERENCE TO RELATED APPLICATIONS

This application is related to and claims priority to U.S. Provisional Patent Application Ser. No. 61/417,718, entitled "Quick Loading Magazine," filed Nov. 29, 2010, which is incorporated herein by reference in its entirety and for all purposes.

FIELD OF THE INVENTION

This disclosure relates generally to ammunition magazines, and more specifically to a quick loading ammunition magazine for firearms.

BACKGROUND

Many firearms utilize a magazine to store ammunition (e.g., bullets) for the firearm. Often, the magazine is configured to store one or more bullets (or other rounds of ammunition) in one or more column(s) within a bullet channel. A top end of the magazine typically includes a feeder lip and is configured to attach to the firearm. A bottom end of the magazine is typically closed such that the bullets do not fall out of the magazine. A spring, with one end attached to the top of the magazine in the bullet channel and a second end attached to a follower, is included in the bullet channel. The spring can be a compression spring or a constant force spring. The spring may be arranged in alternative ways in order to achieve the goal of isolating the bullet channel, allowing unencumbered loading of the ammunition. When bullets are loaded into the top end of the magazine, the bullets push down the follower and load the spring. The spring, through the follower, exerts pressure on the bullets, pushing them toward the feeder lip. Loading mechanisms within the firearm are typically configured to remove a bullet that is pressed up against the feeder lip by the follower and spring and move the bullet into a firing chamber of the firearm. Thus, the bullet can be fired by the firearm and another bullet in the magazine (if present) is pushed into the feeder lip by the follower and spring and is ready for loading into the firearm when the firearm is ready for another bullet.

However, in order for a user to load bullets into the magazine through the feeder lip, the user typically must exert sufficient force to push down the follower and overcome the force of the spring so that the bullet enters the magazine. This may be difficult and cumbersome, making it more difficult for the user to load the magazine. Further, repeatedly loading of the spring in order to load the magazine may unduly wear the spring, damaging the magazine. As the spring is the mechanism by which bullets are pushed up into the feeder lip, so that they are ready to be removed by the firearm for firing, wearing of the spring may render the magazine unusable, thus shortening the operating life of the magazine.

SUMMARY

The present disclosure provides a quick loading magazine that is easier and less cumbersome than previous ammunition magazines. The quick loading magazine includes an upper portion that is coupled to a lower portion (by, for example, a hinge mechanism that allows the lower portion to be at least partially decoupled from the upper portion). The upper and lower portions may include upper and lower housings, respectively. A bullet channel is defined within at least the upper portion. The top of the upper portion includes a feeder lip. The upper portion and lower portion each define an opening that is at least partially concealed when the two portions are coupled together. A follower is configured to travel within the bullet channel. Further, a slider channel is defined within the upper portion and lower portion and a slider is configured to travel within the slider channel. The slider is coupled to the follower (by, for example, a spring such as a constant force spring).

The slider is operable between a first position near the top of the upper portion and a second position in the lower portion. When the slider is positioned in the first position, the spring (or other coupling mechanism) pulls the follower towards the top of the bullet channel in the upper portion. If bullets are located in the bullet channel, the spring is loaded and pulls the follower upwards which in turn forces the bullets up the bullet channel and into the feeder lip one at a time. If no bullets are present in the bullet channel, the spring may maintain the follower in the upper portion of the magazine.

When the slider is positioned in the second position, the follower is pushed into the lower portion because of the spring coupling the follower and the slider. Thus, the lower portion (where the slider and follower are located when the slider is in the second position) may be at least partially decoupled from the upper portion in order to expose the opening at the bottom of the upper portion such that bullets may be loaded into the opening. The lower portion may then be fully re-coupled to the upper portion, again concealing the opening, and the slider may be moved to the first position. The spring begins to be loaded when the follower engages the bullets (thereby not being able to advance any further up the chamber) while the slider continues to be moved upwards to the first position.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

FIG. 2K includes several views of a first section of the lower portion of the quick loading magazine of FIG. 2A.

FIG. 2N includes several views of a follower of the quick loading magazine of FIG. 2A.

FIG. 2O is an isometric view of a slider of the quick loading magazine of FIG. 2A.

DETAILED DESCRIPTION OF THE EMBODIMENTS

The description that follows includes sample systems, apparatuses, and methods that embody various elements of the present disclosure. However, it should be understood that the described disclosure may be practiced in a variety of forms in addition to those described herein.

The present disclosure provides a quick loading magazine that is easier and less cumbersome than previous ammunition magazines. The quick loading magazine includes an upper portion that is coupled to a lower portion (by, for example, a hinge mechanism that allows the lower portion to be at least partially decoupled from the upper portion). The upper and lower portions may include upper and lower housings, respectively. A bullet channel is defined within at least the upper portion. The top of the upper portion includes a feeder lip. The upper portion and lower portion each define an opening that is at least partially concealed when the two portions are coupled together. A follower is configured to travel within the bullet channel. Further, a slider channel is defined within the upper portion and lower portion and a slider is configured to travel within the slider channel. The slider is coupled to the follower (by, for example, a spring such as a constant force spring).

The slider is operable between a first position near the top of the upper portion and a second position in the lower portion. When the slider is positioned in the first position, the spring (or other coupling mechanism) pulls the follower towards the top of the bullet channel in the upper portion. If bullets are located in the bullet channel, the spring is loaded and pulls the follower upwards which in turn forces the bullets up the bullet channel and into the feeder lip one at a time. If no bullets are present in the bullet channel, the spring may maintain the follower in the upper portion of the magazine.

When the slider is positioned in the second position, the follower is pushed into the lower portion because of the spring coupling the follower and the slider. Thus, the lower portion (where the slider and follower are located when the slider is in the second position) may be at least partially decoupled from the upper portion in order to expose the opening at the bottom of the upper portion such that bullets may be loaded into the opening. The lower portion may then be fully re-coupled to the upper portion, again concealing the opening, and the slider may be moved to the first position. The spring begins to be loaded when the follower engages the bullets (thereby not being able to advance any further up the chamber) while the slider continues to be moved upwards to the first position.

Figure 1A:
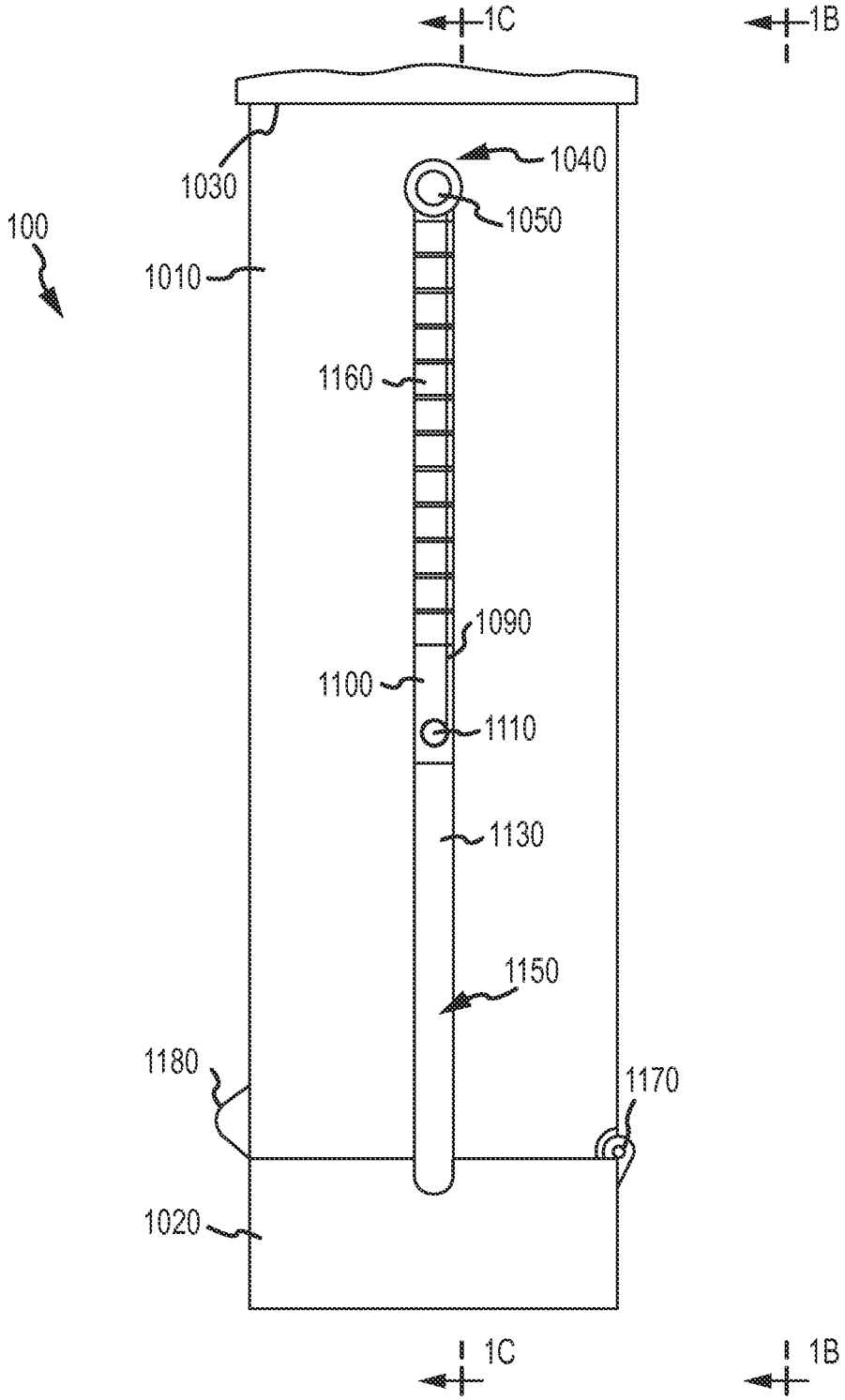
FIG. 1A is a front plan view views illustrating an embodiment of a quick loading magazine in accordance with the present disclosure.

FIG. 1A is a front plan view of an embodiment of a quick loading magazine 100 in accordance with the present disclosure. The magazine 100 may include an upper portion 1010 and a lower portion 1020, which may be coupled together. The upper portion 1010 may be coupled to the lower portion 1020 by, for example, a hinge mechanism 1170 and may be selectively locked by a locking mechanism 1180 (which may be any mechanism suitable for locking two hinged portions together). The top of the upper portion 1010 includes a feeder lip 1030. As explained in more detail below, the quick loading magazine 100 may include a follower 1100 operable to travel within a bullet channel to push bullets 1160 (if present within the bullet channel) toward the feeder lip 1030.

The upper and lower portions may define a slider channel 1150 and a bullet channel 1120. The slider channel may be an enclosed space between an outer wall of the upper and lower portions and an inner wall of the upper and lower portions, and the bullet channel may be an enclosed space between another outer wall of the upper and lower portions and the inner wall. Each of the channels 1150, 1120 may include an aperture configured to allow a post or other member to slide along the aperture.

The quick loading magazine 100 may include a slider 1040 which is operable to travel within a slider channel 1150 between a first position and a second position. The slider 1040 may include a knob 1050, a slider spring 1060, a knob post 1070, a blocking member, and a spool post 1080. The slider may be coupled to the follower 1100 by a spring 1090. The slider channel 1150 may include an external aperture 1130 opening to the outside of the quick loading magazine 100 to allow the knob 1050 of the slider 1040 to be located outside of the quick loading magazine 100 while a portion of the slider remains in the interior of the slider channel 1150. The spring post may, for example, extend out from the blocking member through the external aperture 1130 of the slider channel 1150.

The spring 1090 may be a constant force spring in some embodiments, and may be configured such that the spring 1090 is not stretched when the slider 1040 is positioned in the first position and bullets 1160 are not located within the bullet channel. However, even though the spring 1090 is not stretched when the slider 1040 is positioned in the first position and bullets 1160 are not located within the bullet channel, the spring 1090 may still pull the follower 1100 toward the top of the upper portion 1010 when the slider 1040 is positioned in the first position.

Figure 1B:
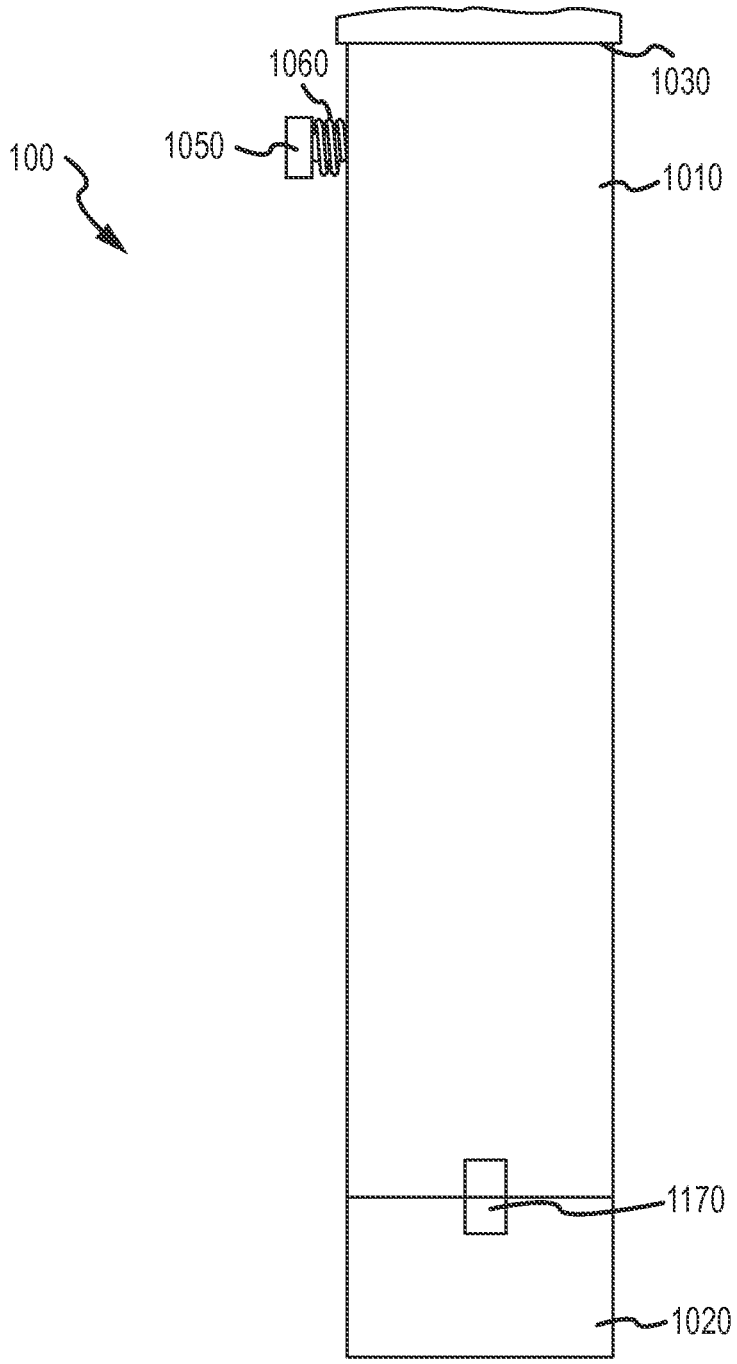
FIG. 1B is a right plan view of the quick loading magazine of FIG. 1A, viewed along line 1B-1B in FIG. 1A.

FIG. 1B is a right plan view of the quick loading magazine 100. A slider spring 1060 may be positioned between the upper portion 1010 and the knob 1050 and may be configured to bias the knob 1050 away from the upper portion 1010. One or more washer(s) may be positioned between the slider spring 1060 and the upper portion 1010 in some embodiments, such as if the diameter of the slider spring is less than the width of the external aperture 1130. In other embodiments, a washed may be placed elsewhere on the slider 1040. The operation of the slider spring 1060 will be discussed in more detail below.

Figure 1C:
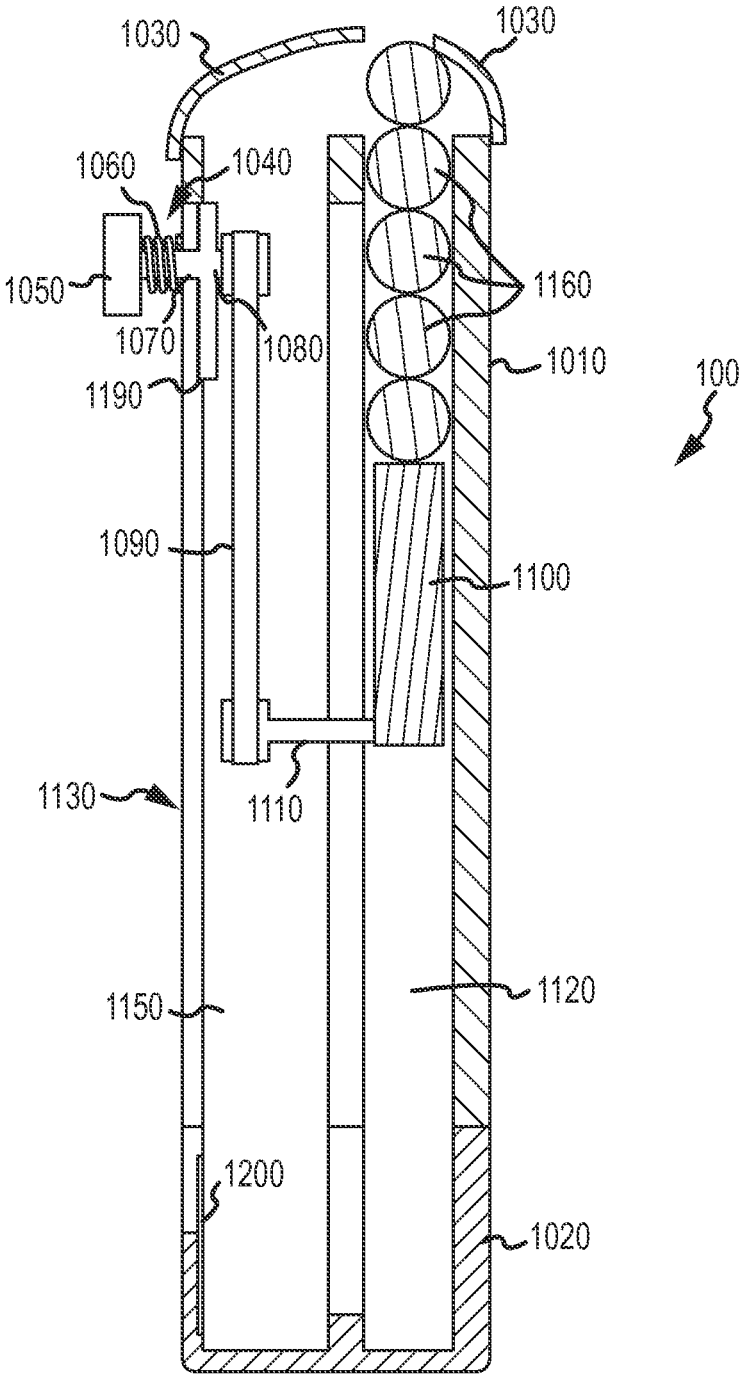
FIG. 1C is a cross-section view of the quick loading magazine of FIG. 1A, viewed along line 1C-1C in FIG. 1A, with bullets loaded into the bullet chamber and the slider in a first position.

FIG. 1C illustrates a cross-section view of the quick loading magazine 100 to highlight its internal operation. A plurality of bullets 1160 and the follower 1100 may be positioned within a bullet channel 1120. As explained above, the bullet channel 1120 may be defined by a first outer wall and an inner wall. The inner wall may have an aperture defined in it to allow for the post 1110 of the follower 1100 to travel within. The slider 1040 may be positioned within a slider channel 1150, which as explained above may be defined by a second outer wall and the inner wall. The second outer wall may include the external aperture 1130 of the slider channel 1150, through which the knob post 1070 projects. The slider 1040 may also include a spool post 1080 which may couple the slider 1040 to a first end of the spring 1090. As illustrated, the other end of the spring 1090 may be coupled to the post 1110 of the follower 1100. When bullets 1160 are present in the bullet channel 1120 and the slider 1040 is positioned in the first position within the slider channel 1150, the spring 1090 may be loaded. When loaded, the spring 1090 may pull the follower 1100 toward the top of the upper portion 1010, thereby pulling the bullets 1160 up the bullet channel 1120 and into the feeder lip 1030.

As mentioned, in some embodiments, the spring 1090 may be a constant force spring (although in other implementations the spring may be another kind of spring, such as a compression spring or coil spring, as described below). In still other embodiments, a different biasing member may be used in place of a spring. In embodiments with a constant force spring 1090, the spring may be a length of material (such as steel) that curls into a roll when force is not exerted upon the length of material and uncurls into a ribbon when sufficient force is exerted to uncurl the material. As such, the spool post 1080 of the slider 1040 and the post 1110 of the follower 1100 may each include a spool that is coupled to a respective end of the material of the constant force spring 1090. When the material is stretched, the spools may roll on their respective posts 1080, 1110 to allow the material to uncurl off of the spools, with the ends of the material still coupled to the spools. When the spring 1090 no longer it is loaded, the spools may roll on their respective posts 1080, 1110 to allow the material to curl onto the respective spools.

The slider channel 1150 may include a plurality of indents 1190, 1200. One indent 1190 may be positioned in a portion of the slider channel 1150 located in the upper portion 1010 and may be configured to lock the blocking member of the slider 1040 into place in the first position. Similarly, a second indent 1200 may be positioned in a portion of the slider channel 1150 located in the lower portion 1020 and may be configured to lock the blocking member of the slider 1040 into place in the second position. The slider spring 1060 may bias the blocking member of the slider 1040 such that it seats in one of the indents 1190, 1200. When the slider 1040 is seated in either the first position or second position (by the blocking member being accommodated in either of the indents 1190, 1200), force may be exerted upon the knob 1050 sufficient to overcome the resistance of the slider spring 1060 (e.g., compress it) and dislodge the blocking member from the respective indent 1190, 1200, thereby allowing the slider 1040 to move along the slider channel 1150 to move the slider between the first and second positions. Note that while the indents 1190, 1200 are illustrated near the top of the top portion 1010 and near the bottom of the bottom portion 1020, there may be any number of indents located along the outer wall of the slider channel 1150. One alternate embodiment for indents 1190, 1200 is illustrated in FIGS. 1G and 1H, and described in further detail below. Other indents and other types of mechanisms for locking the slider into the first and second positions are also contemplated.

Figure 1D:
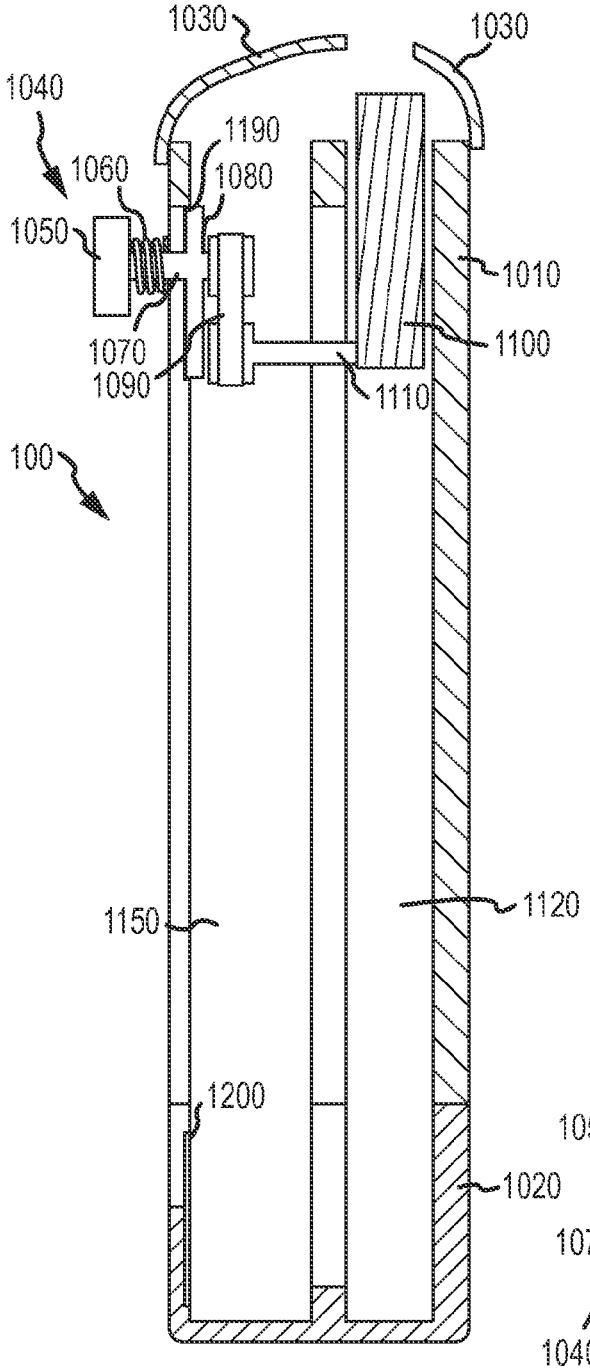
FIG. 1D is a cross-section view similar to the cross-section view of FIG. 1C, but with no bullets in the bullet chamber.

FIG. 1D illustrates a cross-section view of the quick loading magazine 100 but without bullets 1160 in the bullet channel 1120. The spring 1090 pulls the follower 1100 toward the top of the bullet channel 1120.

Figure 1E:
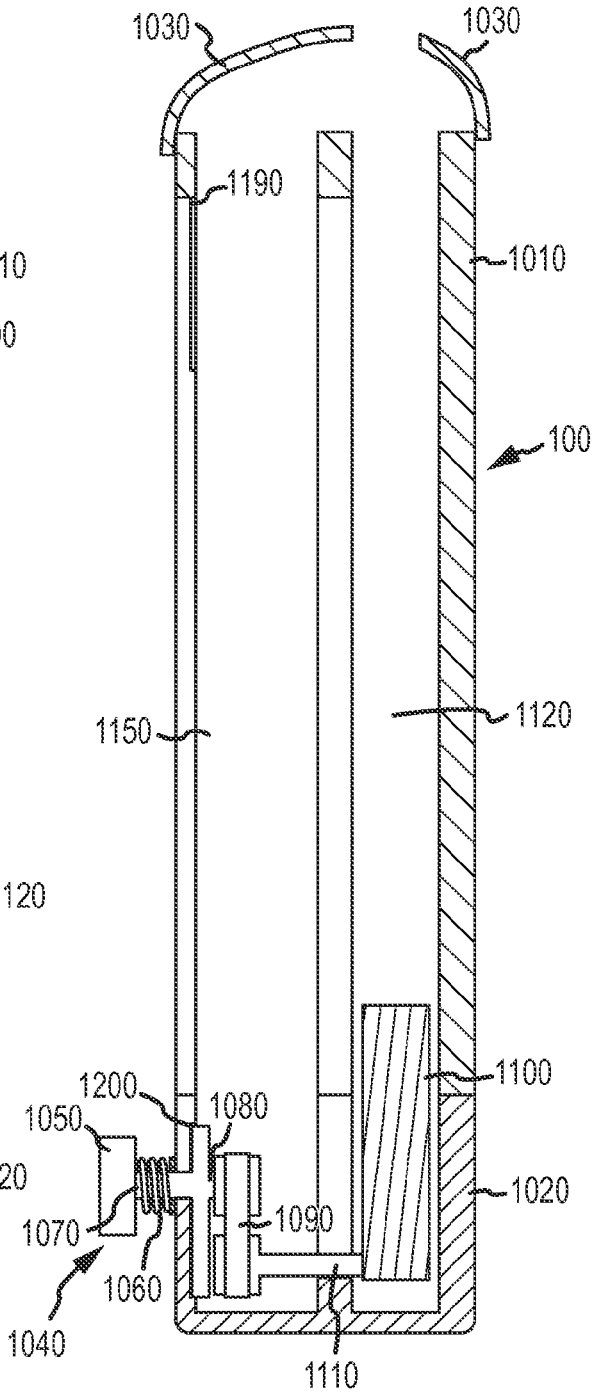
FIG. 1E is a cross-section view similar to the cross-section view of FIG. 1D, but with the slider in a second position.

FIG. 1E illustrates a cross-section view of the quick loading magazine 100 without bullets 1160 in the bullet channel 1120 as illustrated in FIG. 1D, but with the slider 1040 positioned in the second position. The movement of the slider 1040 to the second position forces the follower 1100 toward the bottom of the bullet channel 1120 because of the spring coupling the post 1080 of the slider 1040 and the post 1110 of the follower.

Figure 1F:
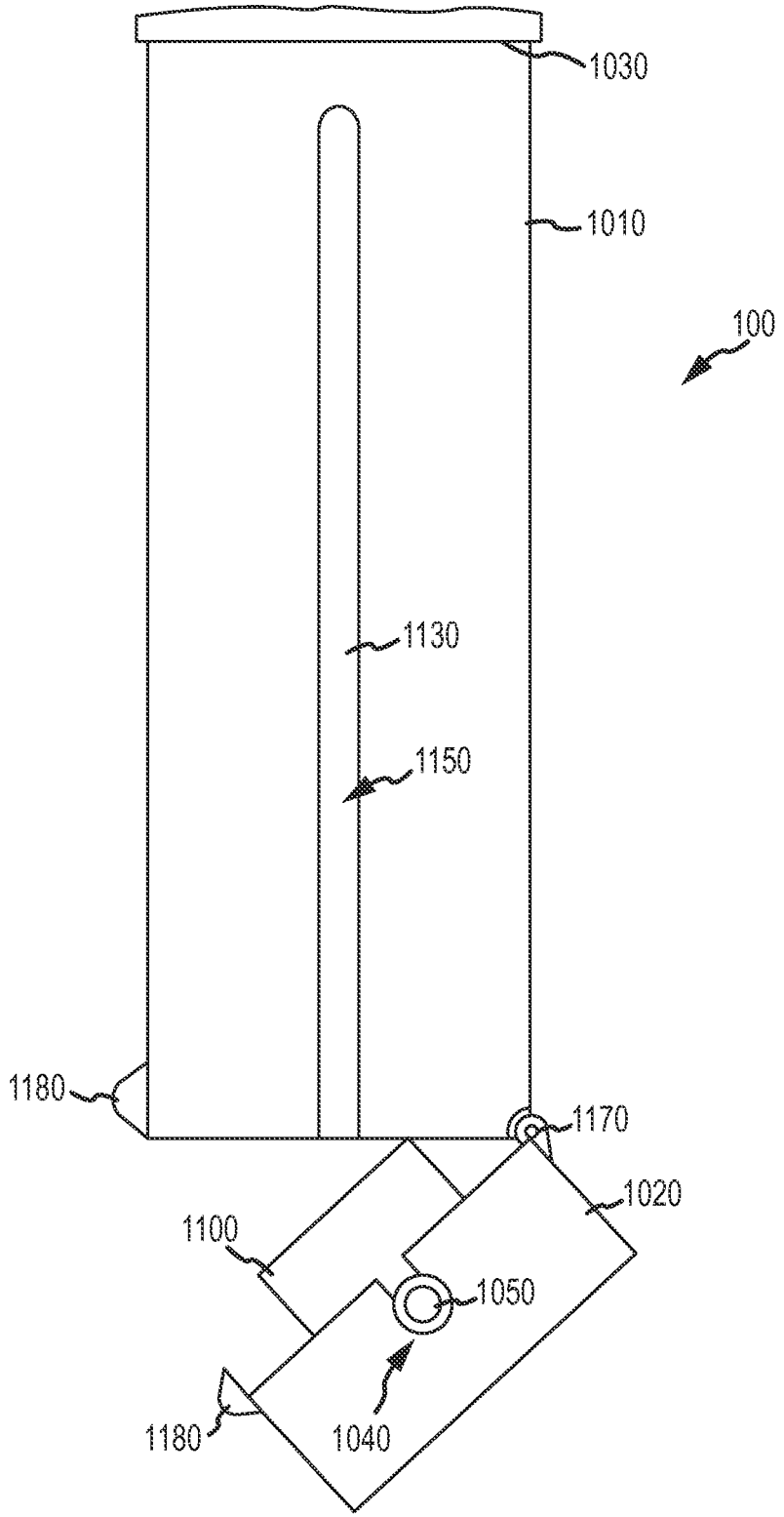
FIG. 1F is a front plan view of the quick loading magazine of FIG. 1A in a partially open configuration.
Figure 1G:
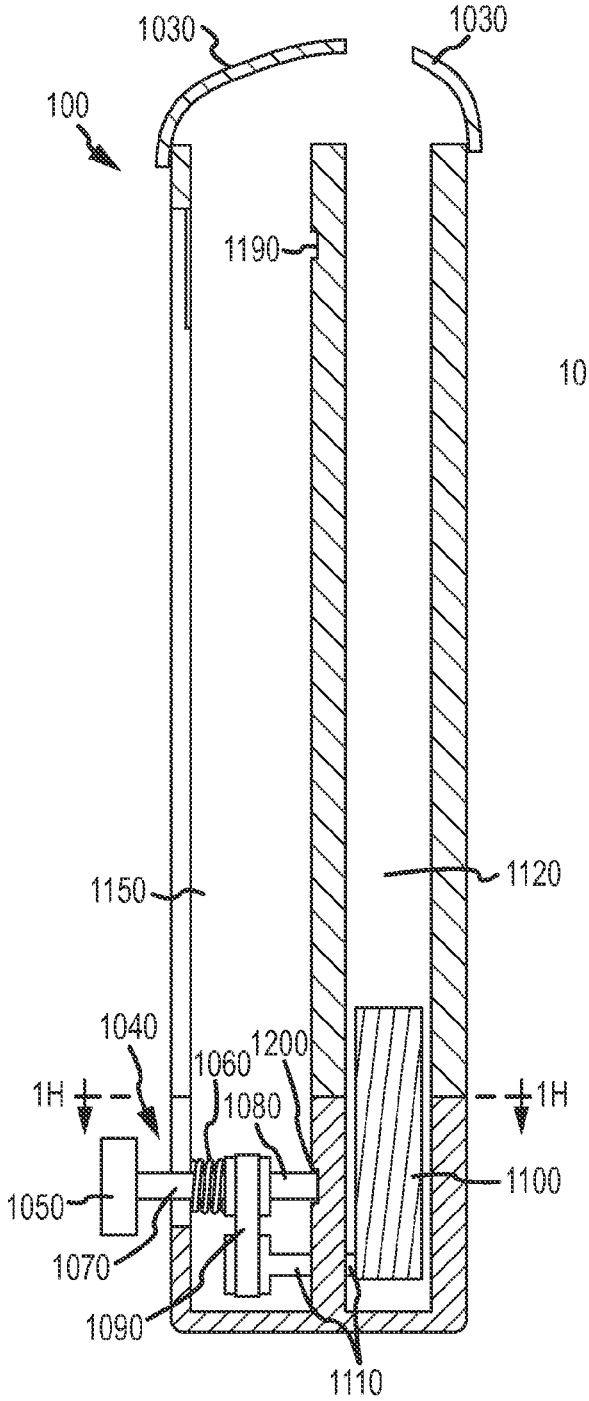
FIG. 1G is a cross-section view of an embodiment of a quick loading magazine.
Figure 1H:
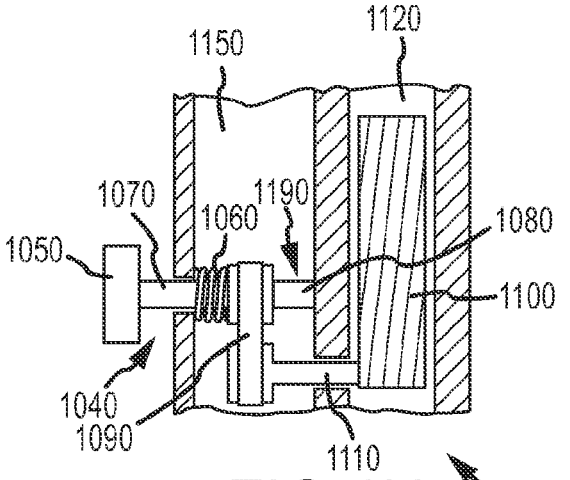
FIG. 1H is a cross-section view of the quick loading magazine of FIG. 1G, viewed along line 1H-1H in FIG. 1G.
Figure 1I:
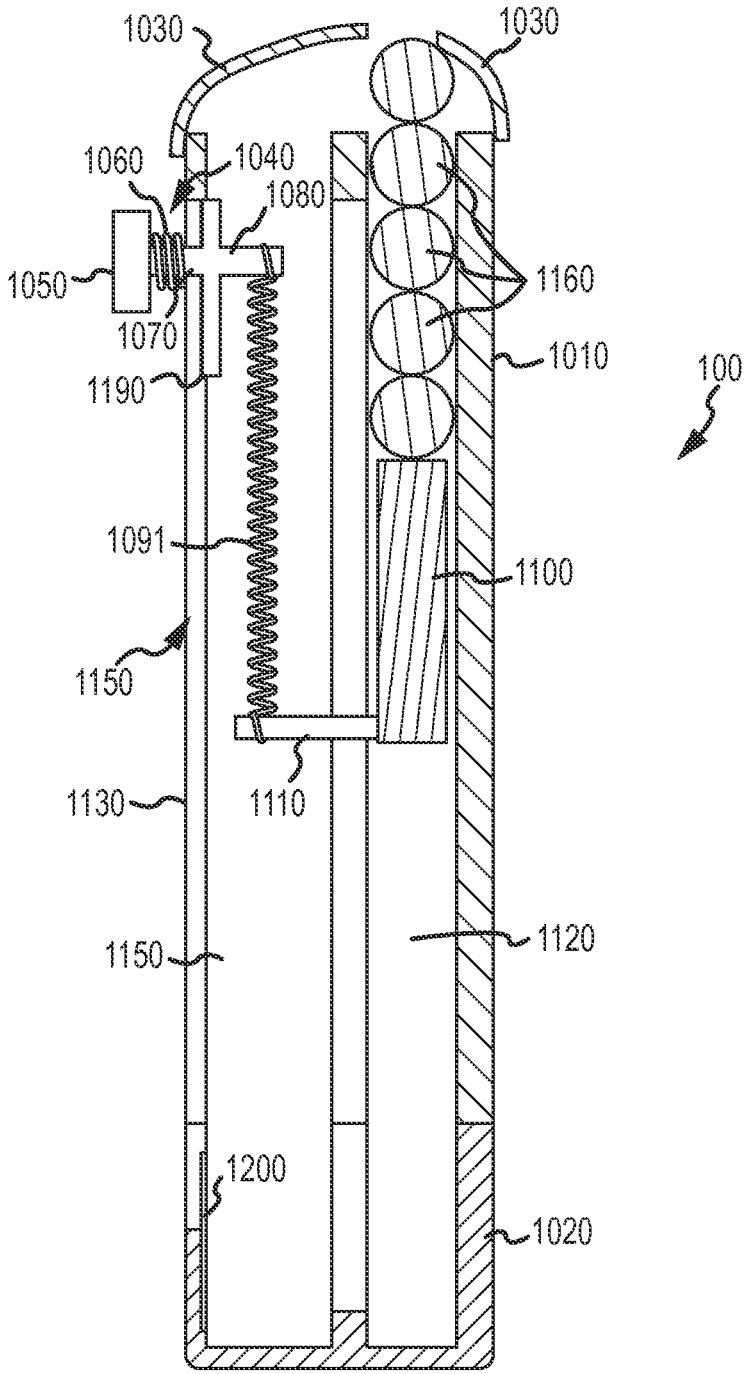
FIG. 1I is a cross-section view of an embodiment of a quick loading magazine.

As illustrated by FIG. 1F, when the slider is in the second position, the lower portion 1020 of the quick loading magazine 100 may be partially decoupled from the upper portion 1010 by unlocking the locking mechanism 1180 and rotating the hinge mechanism 1170. In an open configuration, bullets 1160 may be loaded into the bullet channel 1120 before rotating the hinge mechanism 1170 to again attach the lower portion 1020 to the upper portion 1010, locking the locking mechanism 1180, and moving the slider 1040 to the first position whereupon the quick loading magazine 100 may be ready for use with a firearm.

FIG. 1G illustrates a cross-section view of a quick loading magazine 100, with an alternate type of indents 1190, 1200. In this embodiment, the indents 1190, 1200 may be positioned on the inner wall of the slider channel 1150 of the quick loading magazine 100, rather than the outer wall. The slider 1040 may have the spring 1060 positioned inside the slider channel 1150 so as to bias the spool and spool post 1080 towards the inner wall, and to bias the knob towards the upper portion 1010. The spool post 1080 may extend past the spool, and may have a protrusion configured to be selectively positioned within an indent 1190, 1200. As above, one or more washer(s) may separate the spring from the spool in some embodiments, or a washer may be positioned elsewhere, or no washer may be used. The protrusion of the spool post 1080 may seat into one of the indents 1190, 1200 by force of the spring 1060. In order to disengage the spool post 1080 from one of the indents 1190, 1200, a user may pull the knob 1050 (thereby compressing the spring 1060). If the spring 1060 is compressed, the knob 1050 may allow the slider 1040 to move along the slider channel 1150 until the protrusion of the spool post 1080 again engages one of the protrusions 1190, 1200.

Also, a spring 1090 may couple the slider 1040 to the follower 1100. However, as illustrated in the partial cross-section of FIG. 1H, the aperture in the inner wall that allows the post 1110 of the follower 1100 to extend into the slider channel may not align with and/or be in the same plane as the external aperture 1130 of the slider channel through which the post 1070 of the slider 1040 extends. Although the indents 1190, 1200 in FIG. 1G are illustrated near the top of the top portion 1010 and near the bottom of the bottom portion 1020, there may be any number of indents located along the inner wall.

FIG. 1H illustrates a cross-section view of a quick loading magazine 100 with an alternate type of spring 1091. The spring 1091 may be a coil type spring, or any other type of spring, and may function similar to the constant force spring 1090 shown in the figures and described in detail above.

In operation the quick loading magazine 100 may not require compression of a compression spring during loading of bullets (as the slider and follower are positioned in the second position in the lower portion 1020 of the magazine 100 during loading), and the loading of the quick loading magazine 100 may therefore be simpler and less cumbersome that other bullet magazines. Furthermore, as loading of the quick loading magazine 100 does not exert force upon the spring 1090 during loading of the bullets, loading of the quick loading magazine 100 may cause less wear on the spring 1090 and the quick loading magazine 100 may as a result have a longer useful life as compared with a magazine that exerts force upon its spring during loading.

Although the above describes the quick loading magazine 100 as including specific components such as the hinge mechanism 1170, the locking mechanism 1180, and so on, it should be understood that other components may be utilized to perform similar functions without departing from the scope of the present disclosure. For example, in some implementations the upper portion 1010 and lower portion 1020 may not be coupled by the hinge mechanism 1170 but may instead be completely separable and/or may be coupled by two or more locking mechanisms 1180 disposed on a number of sides of the quick loading magazine 100.

In various implementations, the components of the quick loading magazine 100 may be constructed of a variety of different materials without departing from the scope of the present disclosure. For example, the upper portion 1010, the lower portion 1020, the follower 1100, the slider 1040, the feeder lip 1030, and so on may be constructed of a variety of different suitable plastics, metals, alloys, and so on. By way of a second example, the spring 1090 may be a constant force spring (described in detail above), a compression spring, or any type of biasing member that may exert force. Particular materials utilized to construct the components of the quick loading magazine 100 may be a matter of particular design choice and the use of a variety of different materials in constructing such components is contemplated by the present disclosure.

Figure 2A:
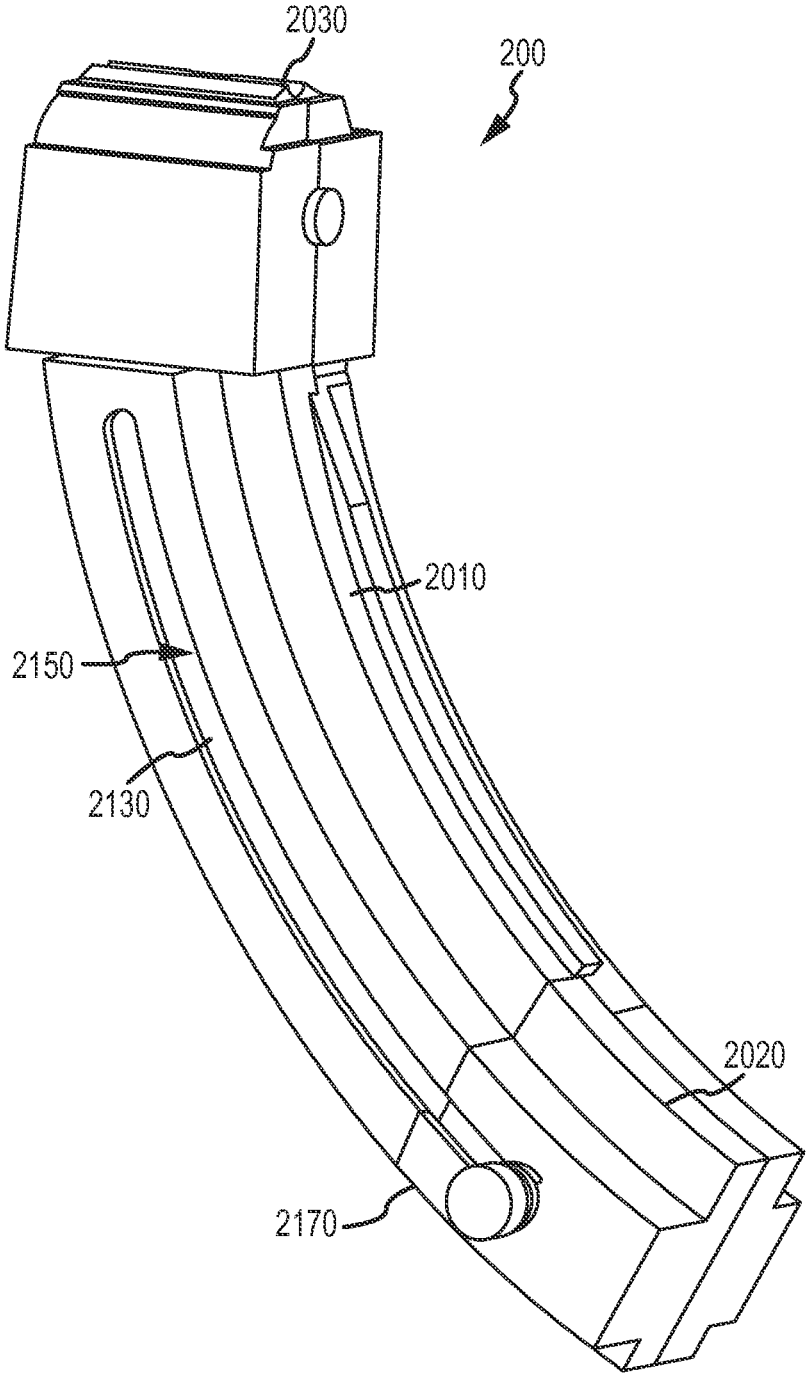
FIG. 2A is an isometric view of an embodiment of a quick loading magazine.

FIG. 2A is an isometric view of an embodiment of a quick loading magazine 200 in accordance with the present disclosure. The quick loading magazine 200 may be similar to the quick loading magazine 100 illustrated in FIGS. 1A through 1I. In this embodiment, the magazine 200 is illustrated as a magazine which may store .22 caliber bullets for a Ruger 10-22 model of firearm, but this is merely for discussion purposes and should not be interpreted as limiting the present disclosure.

As illustrated, the magazine includes an upper portion 2010 and a lower portion 2020, which are shown coupled together. The upper portion 2010 is coupled to the lower portion 2020 via a hinge mechanism 2170. The top of the upper portion 2010 includes a feeder lip 2030. The quick loading magazine 200 may include a follower 2100 which may travel within a bullet channel to push bullets toward the feeder lip 2030.

The quick loading magazine 200 may include a slider 2040 which is operable to travel within a slider channel 2150 between a first position and a second position. The slider 2040 may include a knob 2050, a slider spring 2060, a post 2070, a blocking member, and a spool post 2080. The slider may be coupled to the follower 2100 by a spring 2090. The slider channel 2150 may include an external aperture 2130 opening to the outside of the quick loading magazine 200 to allow the knob 2050 of the slider 2040 to be located outside of the quick loading magazine 200 while a portion of the slider remains in the interior of the slider channel 2150. The spring post may, for example, extend out from the blocking member through the external aperture 2130 of the slider channel 2150. A slider spring 2060 may be located between the upper portion 2010 and the knob 2050 and may be configured to bias the knob 2050 away from the upper portion 2010.

A spring 2090 may couple the slider 2040 and the follower 2100, and may be a constant force spring in some embodiments, and may be configured such that the spring 2090 is not stretched when the slider 2040 is positioned in the first position and bullets are not located within the bullet channel. However, even though the spring 2090 is not stretched when the slider 2040 is positioned in the first position and bullets 2160 are not located within the bullet channel, the spring 2090 may still pull the follower 2100 toward the top of the upper portion 2010 when the slider 2040 is positioned in the first position. The spring 2090 is also configured such that the spring 2090 is loaded when the slider 2040 is positioned in the first position and bullets are located within the bullet channel. When loaded, the spring 2090 may pull the follower 2100 toward the top of the bullet channel of the upper portion 2010, thereby pulling the bullets up the bullet channel and into the feeder lip 2030.

When the slider 2040 is moved to the second position the movement of the slider 2040 to the second position forces the follower 2100 toward and into the lower portion, because of the spring 2090 coupling the post 2080 of the slider 2040 and the post 2110 of the follower. The lower portion 2020 of the quick loading magazine 200 may then be at least partially decoupled from the upper portion 2010 by rotating the hinge mechanism 2170. In this open configuration, bullets may be loaded into the bullet channel before rotating the hinge mechanism 2170 to again attach the lower portion 2020 to the upper portion 2010 and moving the slider 2040 to the first position whereupon the quick loading magazine 200 may be ready for use with a firearm.

In some implementations, the spring 2090 may be a constant force spring, although in other embodiments, the spring 2090 may be a compression spring, coil spring, or any other type of biasing member. A constant force spring 2090 may be a length of material (such as steel) that curls into a roll when force is not exerted upon the length of material and uncurls into a ribbon when sufficient force is exerted to uncurl the material. As such, the spool post 2080 of the slider 2040 and the post 2110 of the follower 2100 may each include a spool (2310 and 2320 respectively) that is coupled to a respective end of the material of the constant force spring 2090. When the material is stretched (e.g., the spring is loaded), the spools 2310, 2320 may roll on their respective posts 2080, 2110 to allow the material to uncurl off of the spools 2310, 2320, with the ends of the material still coupled to the spools 2310, 2320. When the spring 2090 no longer it is loaded, the spools 2310, 2320 may roll on their respective posts 2080, 2110 to allow the material to curl onto the respective spools 2310, 2320.

Similar to the magazine 100 in FIGS. 1C through 1E, the slider channel 2150 may include a first indent (positioned in a portion of the slider channel 2150 located in the upper portion 2010 of the magazine 200) configured to lock the slider 2040 into place in the first position by accommodating the blocking member of the slider 2040, and a second indent (positioned in a portion of the slider channel 2150 located in the lower portion 2020) configured to lock the slider 2040 into place in the second position by accommodating the blocking member of the slider 2040. When the slider 2040 is locked into either the first position or second position (by the blocking member being accommodated by either the indents), force may be exerted upon the knob 2050 sufficient to overcome the resistance of the slider spring 2060 and dislodge the spring post 2080 from the respective indent. Such force may be, for example, pushing the knob 2050 towards the slider channel 2150 in the upper portion 2010.

Figure 2B:
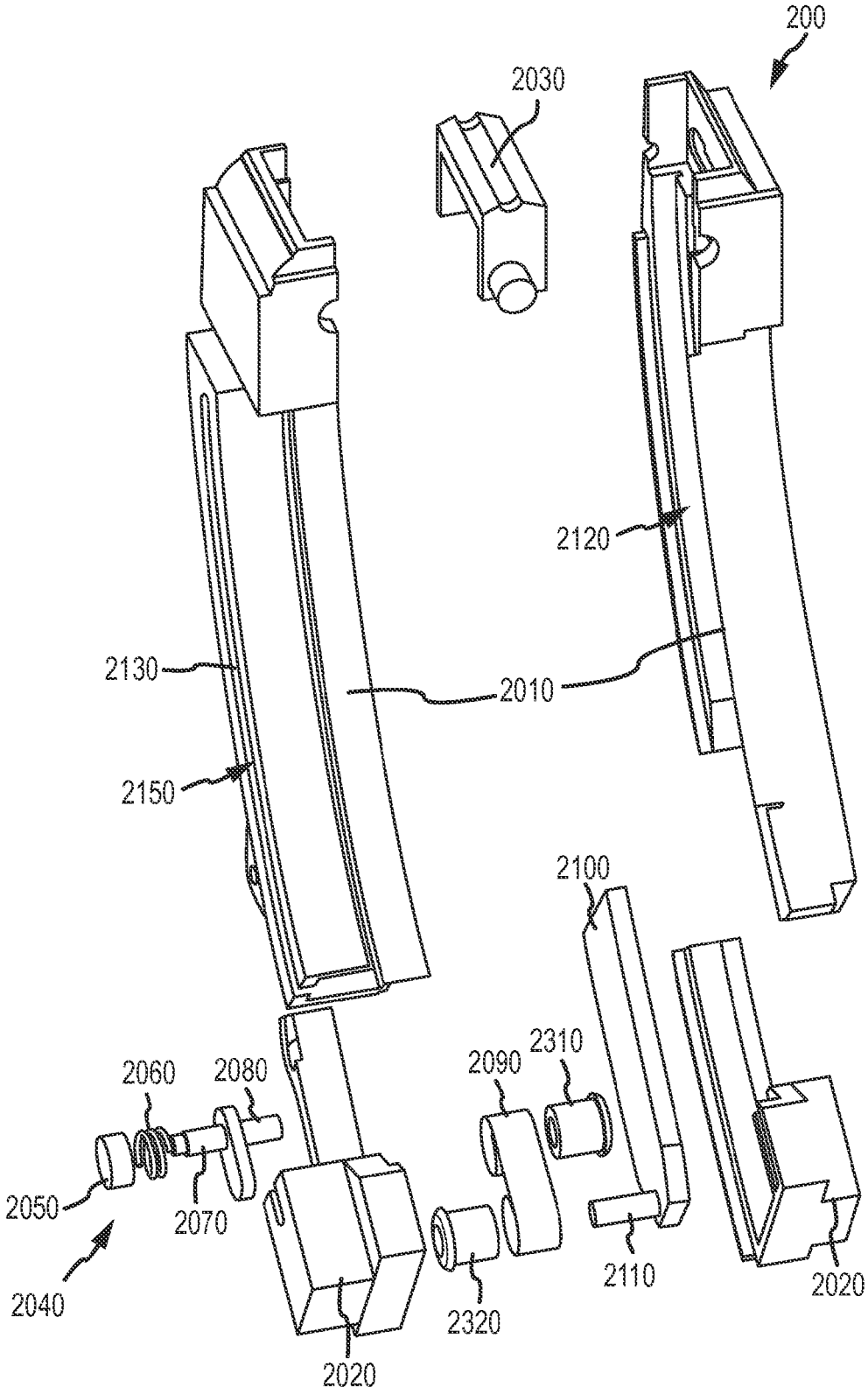
FIG. 2B is an exploded isometric view of the components of the quick loading magazine shown in FIG. 2A.

FIG. 2B is an exploded isometric view of the quick loading magazine 200 (where the slider 2040 is illustrated in approximately the second position) illustrating the upper portion 2010, the lower portion 2020, the feeder lip 2030, the slider channel 2150, the external aperture 2130, the bullet channel 2120, the slider 2040, the knob 2050, the slider spring 2060, the knob post 2070, the spool post 2080, spools 2310, 2320, the spring 2090, the follower 2100, the spring post 2110, and so on.

Figure 2C:
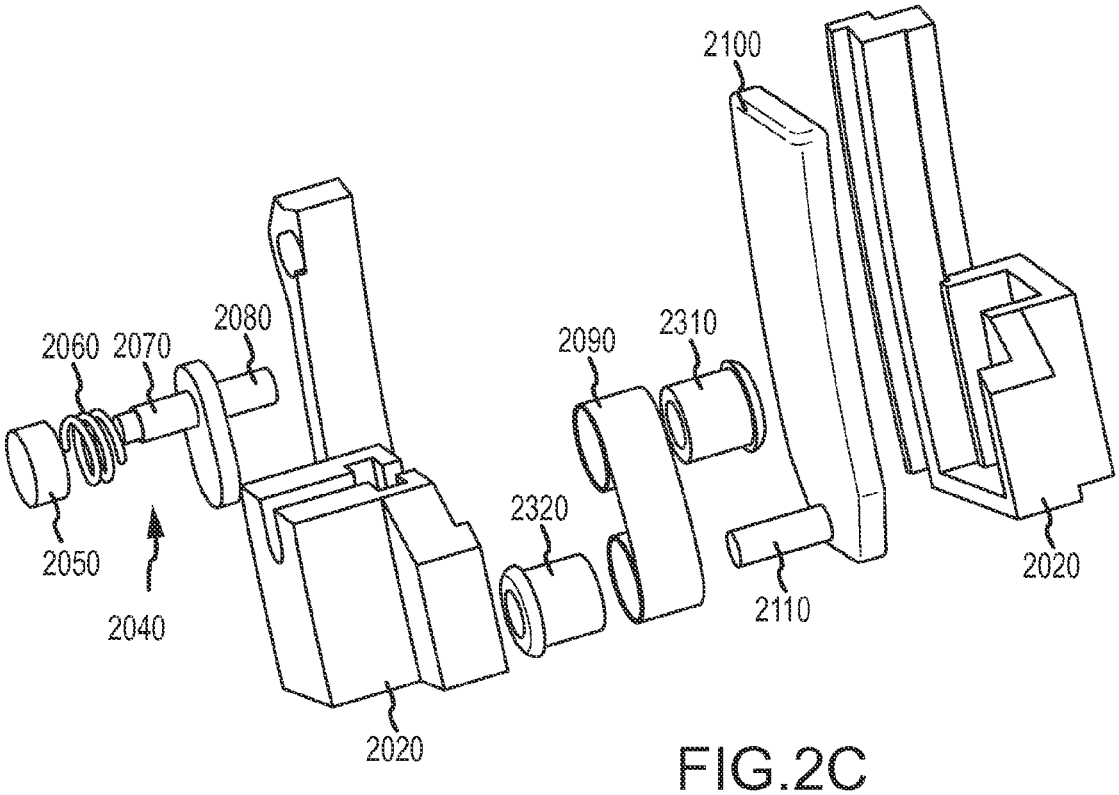
FIG. 2C is an exploded view of some of the components of the quick loading magazine shown in FIG. 2A.

FIG. 2C is an exploded isometric view of the lower portion 2010 of the quick loading magazine 200 (again where the slider 2040 is illustrated in approximately the second position) illustrating the lower portion 2020 as well as the slider 2040, the knob 2050, the slider spring 2060, the knob post 2070, the spool post 2080, spools 2310, 2320, the spring 2090, the follower 2100, the spring post 2110, and so on.

Figure 2D:
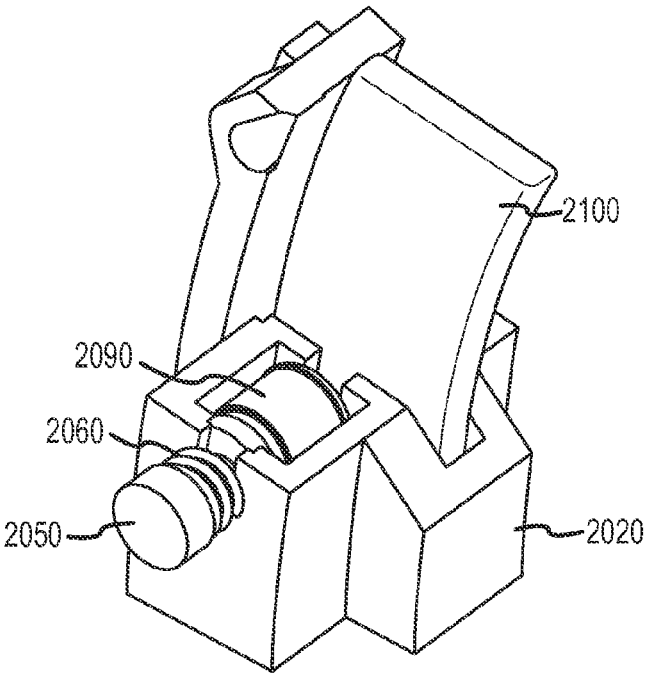
FIG. 2D is an isometric view of the assembled components shown in FIG. 2C.
Figure 2E:
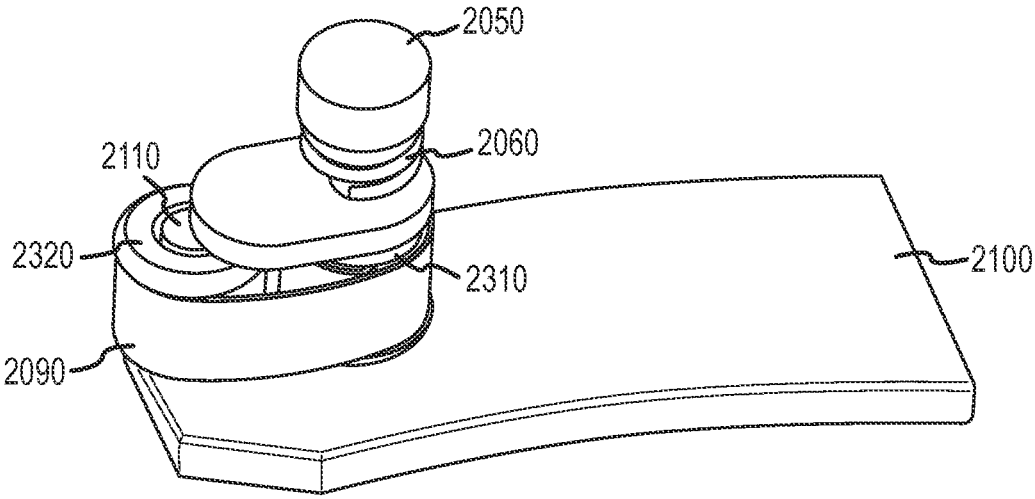
FIG. 2E is an isometric view of some of the components of the quick loading magazine shown in FIG. 2A, with the components assembled.
Figure 2F:
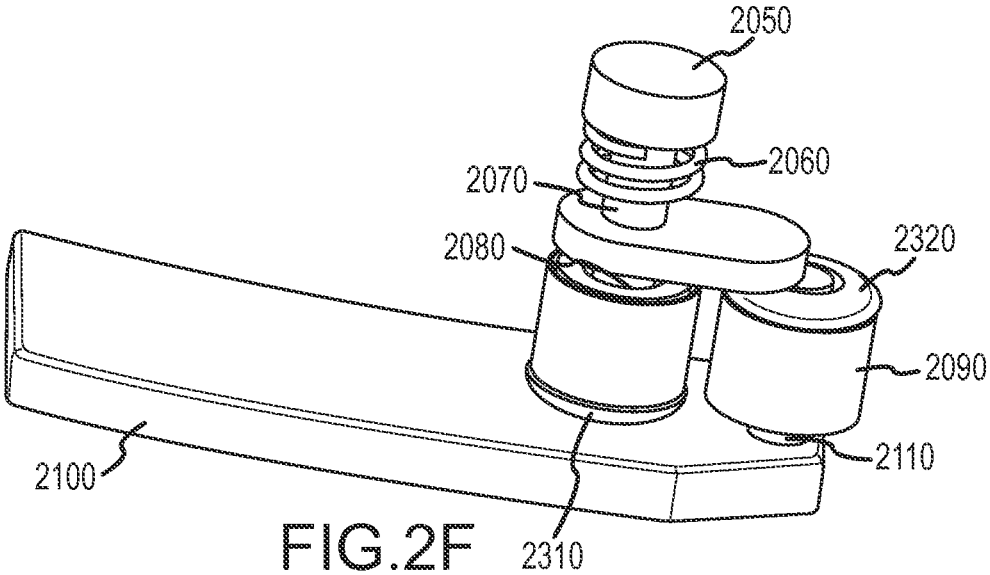
FIG. 2F is an isometric view of the components of FIG. 2E from a different viewing angle.
Figure 2G:
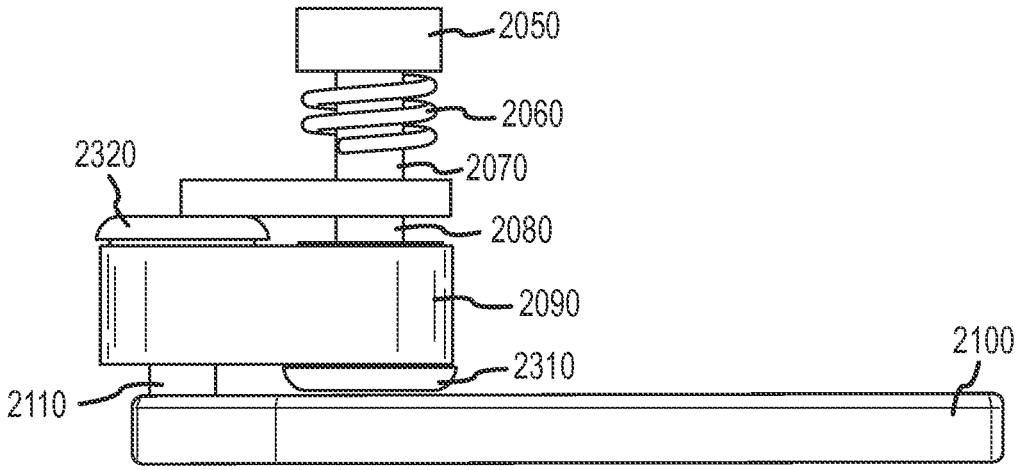
FIG. 2G is an isometric view of the components of FIG. 2E from a different viewing angle.
Figure 2H:
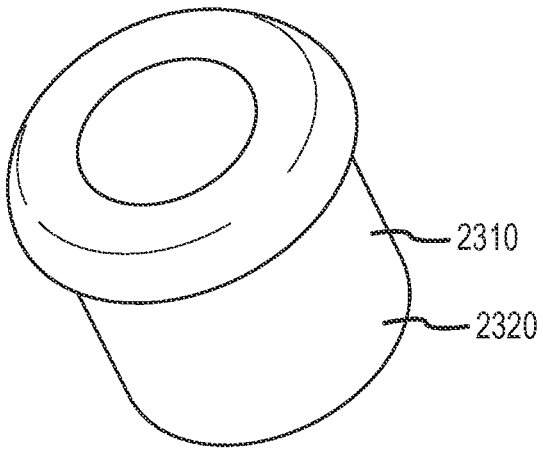
FIG. 2H is an isometric view of a spool for the quick loading magazine of FIG. 2A.
Figure 2I:
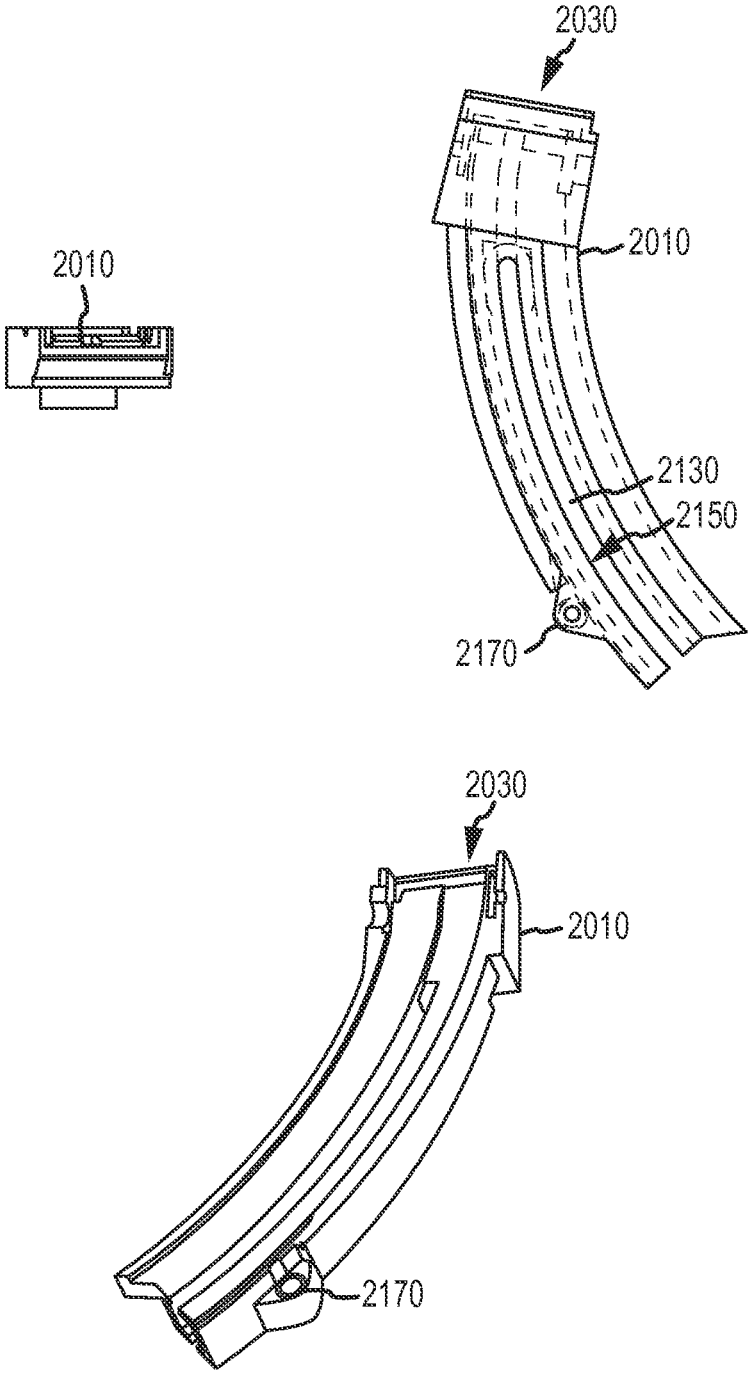
FIG. 2I includes several views of a first section of the upper portion of the quick loading magazine of FIG. 2A.
Figure 2J:
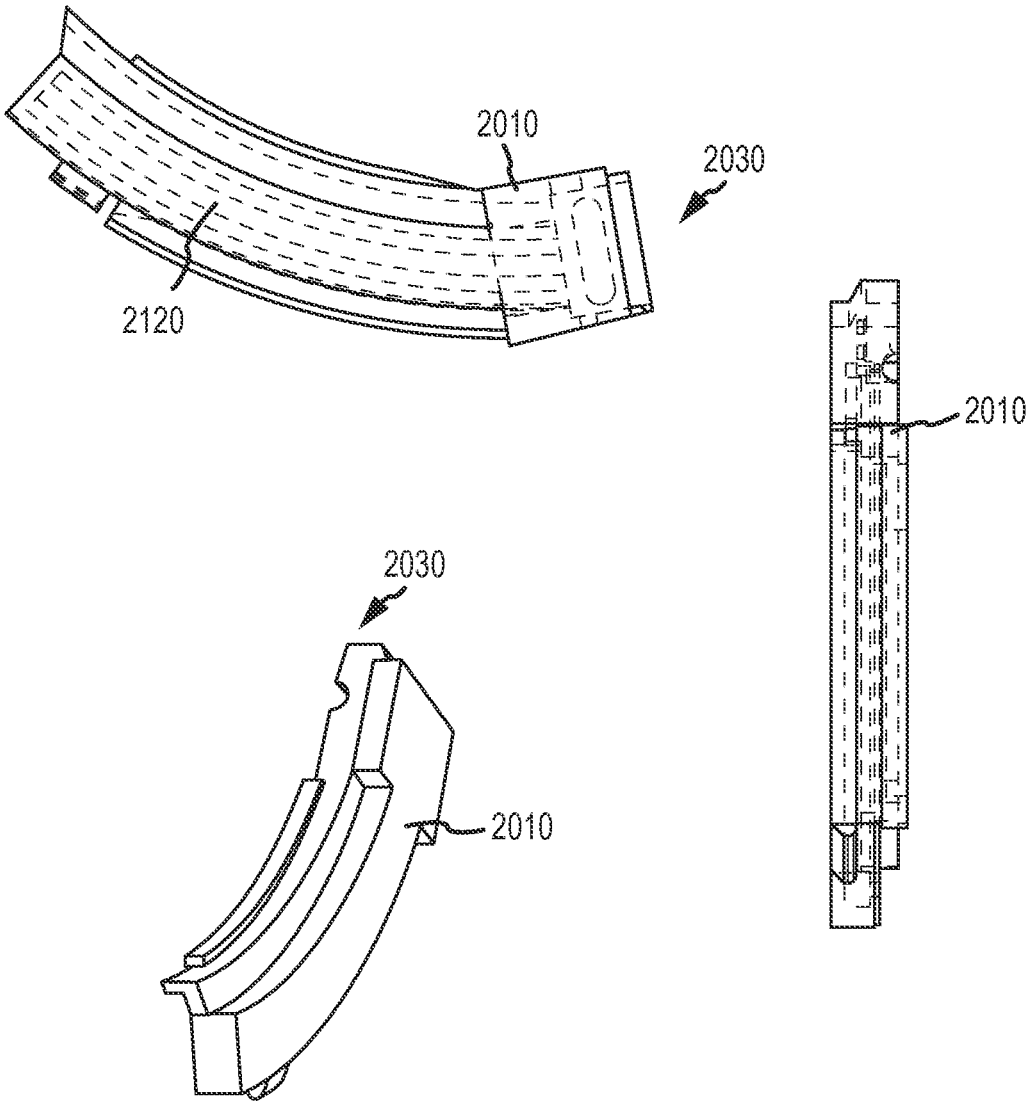
FIG. 2J includes several views of a second section of the upper portion of the quick loading magazine of FIG. 2A.
Figure 2L:
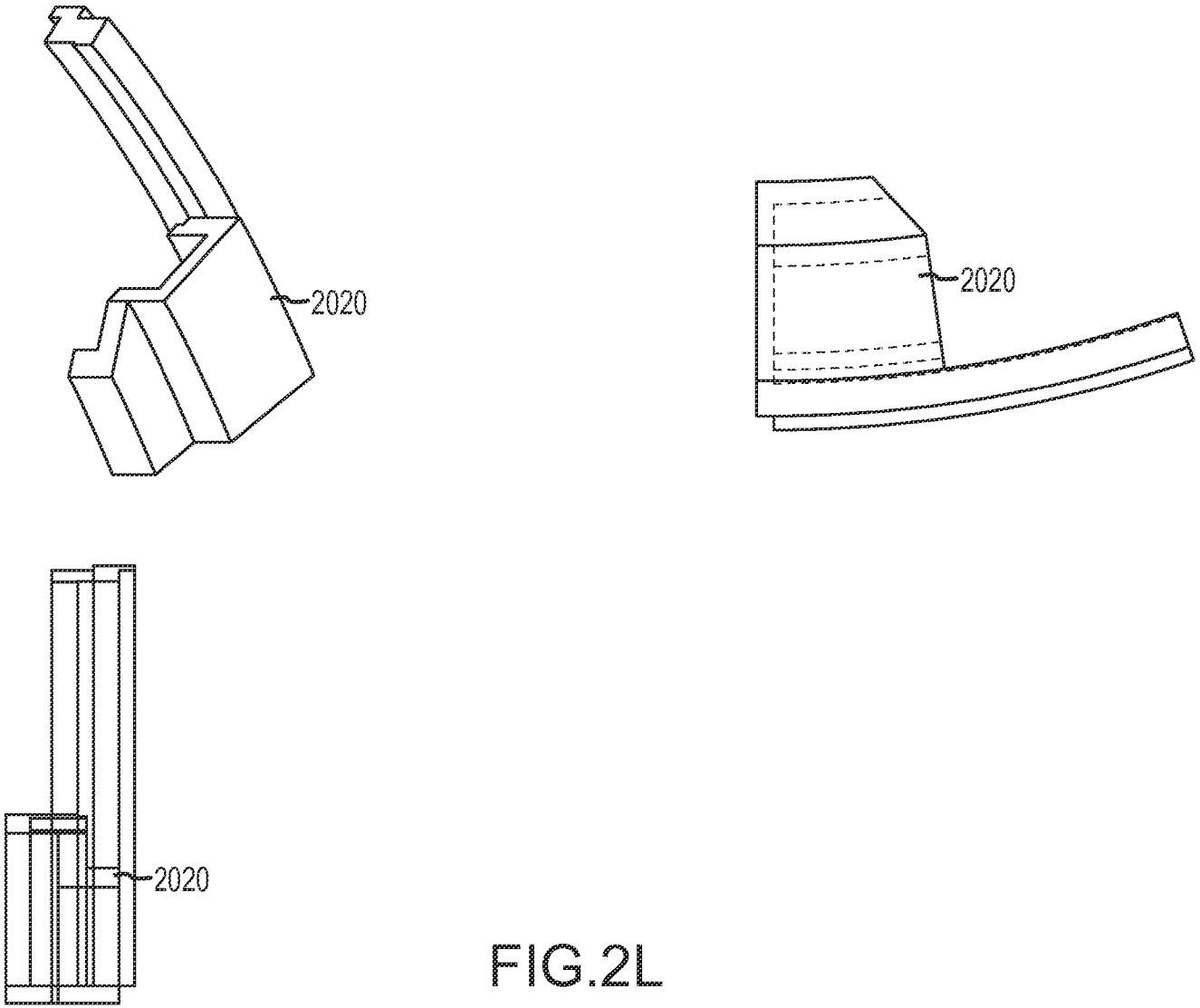
FIG. 2L includes several views of a second section of the lower portion of the quick loading magazine of FIG. 2A.
Figure 2M:
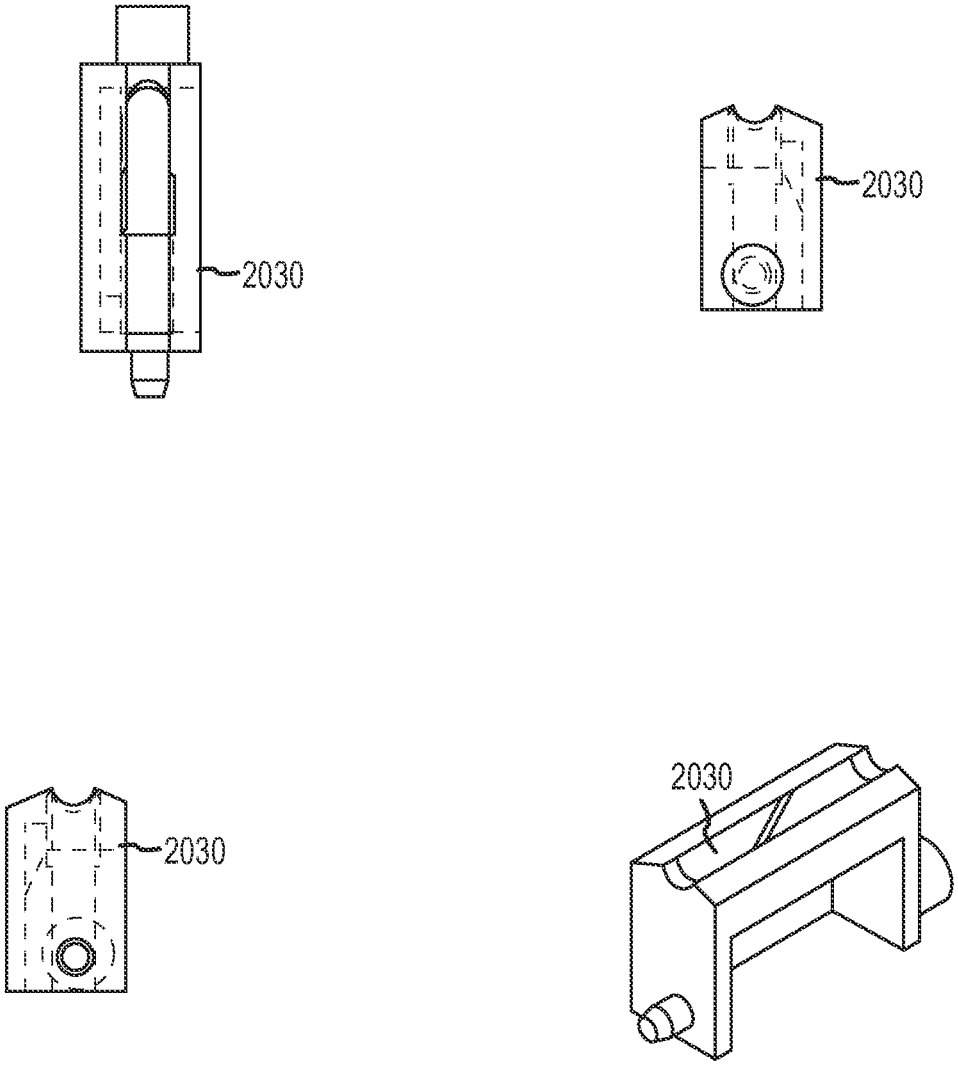
FIG. 2M includes several views of a feeder lip of the quick loading magazine of FIG. 2A.
Figure 20:
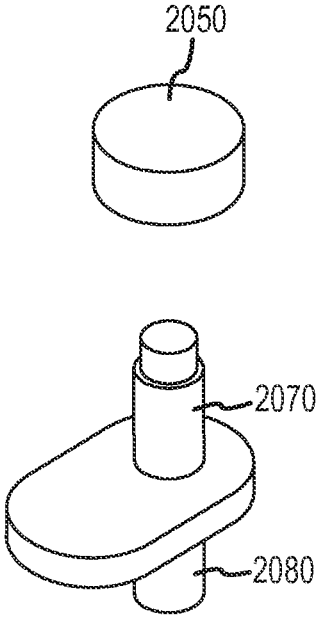

FIG. 2D is an assembled isometric view of the exploded isometric view of the lower portion 2010 of the quick loading magazine 200 (where the slider 2040 is illustrated in the second position) shown in FIG. 2C. FIGS. 2E-2G illustrate various assembled views of the follower 2100, the spring post 2110, the spring post 2080, the slider 2040, the knob post 2070, the slider spring 2060, the knob 2050, the spools 2310, 2320, and the spring 2090 separate from the other components of the quick loading magazine 200.

FIGS. 2H-2O depict machine drawing specifications (showing multiple views) for various components of the quick loading magazine 200. Although specific measurements and dimensions are provided, these are for the purposes of illustration only and are not intended as limiting the quick loading magazine 200.

Although the above describes the quick loading magazine 200 as including specific components such as the hinge mechanism 2170, the spools 2310, 2320, and so on, it should be understood that other components may be utilized to perform similar functions without departing from the scope of the present disclosure. For example, in some implementations the upper portion 2010 and lower portion 2020 may not be connected by the hinge mechanism 2170 but may instead be operable to completely separate and attach via one or more insertion members and one or more apertures that are configured to receive the one or more insertion members.

Figure 3:
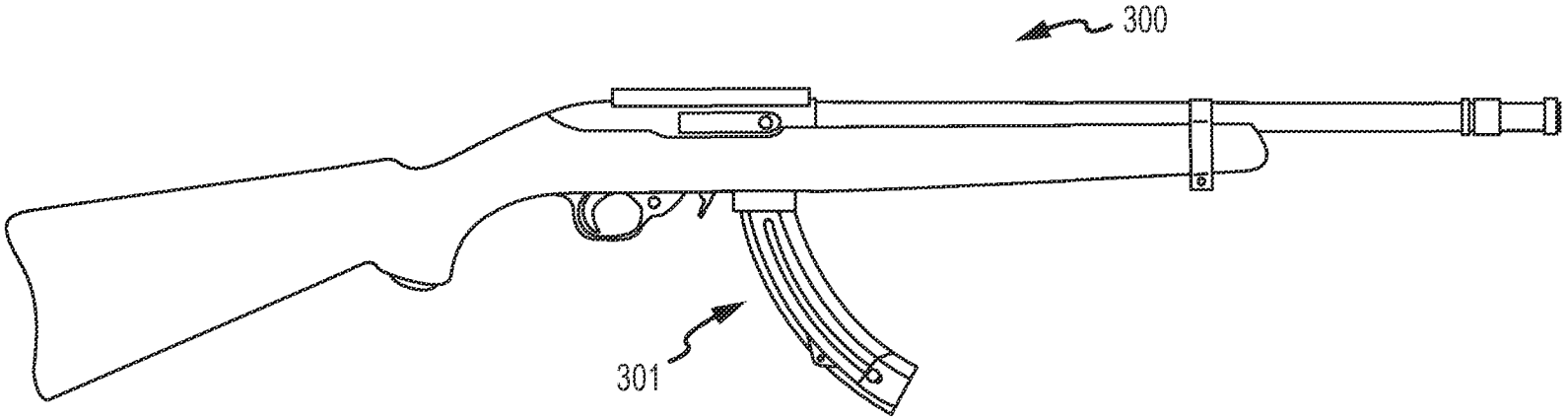
FIG. 3 is a side plan view of a firearm with a quick loading magazine.

FIG. 3 illustrates a side plan view of a firearm 300 with a barrel and a housing. A quick loading magazine 301 may be coupled to the firearm 300 in order to provide bullets to the firearm. The quick loading magazine 301 may be, for example, any of the quick loading magazines 100, 200 illustrated in the figures and described above, or a similar quick loading magazine.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

The apparatuses and associated methods in accordance with the present disclosure have been described with reference to particular embodiments thereof in order to illustrate the principles of operation. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described and are thus within the spirit and scope of this disclosure. Accordingly, it is intended that all such alterations, variations, and modifications of the disclosed embodiments are within the scope of this disclosure as defined by the appended claims. For example, embodiments of the present disclosure may find application in a wide variety of projectile firing devices, such as paintball guns, airsoft guns, pellet guns, etc. Thus, in these embodiments, the term "ammunition," may be used to refer to the projectile for a particular embodiment. These and other variations, modifications, additions, and improvements may fall within the scope of the disclosure as defined in the claims that follow.

Where appropriate, common reference numbers and words are used for common structural and method features. However, unique reference numbers and words are sometimes used for similar or the same structural or method elements for descriptive purposes. As such, the use of common or different reference numbers or words for similar or the same structural or method elements is not intended to imply a similarity or difference beyond that described herein.

In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, clockwise, counterclockwise, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

In some instances, components are described with reference to "ends" having a particular characteristic and/or being connected with another part. However, those skilled in the art will recognize that the disclosed embodiments are not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like.

What is claimed is:

1. An ammunition magazine, comprising:

an upper housing including a top end and a bottom end, the top end including a feeder lip;

a lower housing that is coupled to the bottom end of the upper housing;

a bullet channel configured within at least the upper housing;

a follower that is configured to travel within the bullet channel;

a slider channel parallel to the bullet channel formed within both the upper housing and the lower housing;

a slider configured to travel along the slider channel between a first position substantially within the upper housing and a second position substantially within the lower housing; and a biasing member coupling the slider to the follower;

wherein the biasing member biases the follower such that the follower is configured to provide bullets to the feeder lip when the slider is in the first position, and the lower housing is at least partially selectively decoupleable from the upper housing when the slider is in the second position.

2. The ammunition magazine of claim 1, wherein the biasing member is a constant force spring and further comprising:

a first spool rotatably coupled to the slider; and a second spool rotatably coupled to the follower;

wherein the constant force spring is configured to selectively contract around the first and second spools and to selectively expand.

3. The ammunition magazine of claim 2, wherein the first spool is mounted on a first post of the slider and the second spool is mounted on a second post of the follower.

4. The ammunition magazine of claim 2, wherein the first spool and second spool are disposed within the slider channel.

5. The ammunition magazine of claim 1, wherein the lower housing is coupled to the bottom end of the upper housing via a hinge assembly.

6. The ammunition magazine of claim 1, further comprising a locking mechanism that is operable to lock the lower housing to the upper housing.

7. The ammunition magazine of claim 1, wherein the slider is configured to lock in at least one of the first position or the second position.

8. The ammunition magazine of claim 7, wherein the slider is configured to lock in the at least one of the first position or the second position by engaging a blocking member with an indent disposed in the slider channel.

9. The ammunition magazine of claim 1, wherein the slider is configured to lock in the at least one of the first position or the second position by engaging a post with an indent disposed in an inner wall of the slider channel.

10. The ammunition magazine of claim 1, wherein the slider is connected to a knob that is positioned at least partially outside the slider channel and which is operable to move the slider between the first position and the second position.

11. The ammunition magazine of claim 10, wherein the knob is biased away from the magazine by a slider spring.

12. The ammunition magazine of claim 1, wherein when the lower housing is at least partially decoupled from the upper housing, the bullet channel is configured to receive bullets from the bottom end of the upper housing.

13. The ammunition magazine of claim 1, wherein when the slider is in the second position, the lower housing is capable of being completely decoupled from the upper housing.

14. The ammunition magazine of claim 13, further comprising at least one locking mechanism that is operable to lock the lower housing to the upper housing.

15. The ammunition magazine of claim 1, wherein the biasing member is a configured to exert a pressing force on the follower to bias it toward the feeder lip.

16. The ammunition magazine of claim 1, wherein the slider comprises a post coupled to a knob;

the upper housing and the lower housing together form a separable external wall of the slider channel that defines an outer slot extending between the first position and the second position and is configured to receive the post such that the knob extends outward from the external wall for use in moving the slider between the first and second positions; and the upper housing forms an internal wall between the slider channel and the bullet channel that defines an inner slot configured to allow a portion of the follower to extend through the inner slot and into the slider channel.

17. The ammunition magazine of claim 1, wherein the biasing member is provided in the slider channel.

* * * * *